US005996380A

United States Patent [19]

Harris

[11] Patent Number: 5,996,380

[45] Date of Patent: Dec. 7, 1999

[54] ANTI-ABDUCTION DEVICE

[76] Inventor: Christopher L. Harris, 8811 Autumn Winds Dr., #302, Raleigh, N.C. 27615

[21] Appl. No.: 09/185,314

[22] Filed: Nov. 3, 1998

[51] Int. Cl.[6] ..... E05B 75/00

[52] U.S. Cl. ..... 70/16; 128/878; 473/212; 119/856

[58] Field of Search ..... 70/16; 24/16 PB; 128/878, 879; 473/212, 213, 450, 447, 448; 602/16, 21, 63; 119/770, 792, 810, 811, 856, 857

[56] References Cited

U.S. PATENT DOCUMENTS

| | | | |
|---|---|---|---|
| 3,104,650 | 9/1963 | Grahling | 119/856 |
| 3,297,026 | 1/1967 | Van Pelt | 128/878 |
| 3,426,559 | 2/1969 | Schubach et al. | 70/16 |
| 3,536,068 | 10/1970 | Stubbs | 128/878 |
| 4,014,327 | 3/1977 | Spiro | 473/212 |
| 4,239,228 | 12/1980 | Norman et al. | 473/212 |
| 4,273,336 | 6/1981 | Larkey | 473/213 |
| 4,377,284 | 3/1983 | Okerlin | 473/450 |
| 4,688,564 | 8/1987 | Kelly | 128/878 |
| 4,691,924 | 9/1987 | Strong | 473/212 |
| 4,745,883 | 5/1988 | Baggetta | 119/856 X |
| 4,765,279 | 8/1988 | Klickstein | 119/856 |
| 4,977,625 | 12/1990 | Charters, III | 128/77 X |
| 5,360,019 | 11/1994 | Witzel et al. | 128/878 |
| 5,469,813 | 11/1995 | Peden | 119/770 |
| 5,479,943 | 1/1996 | Kuhnell, III | 70/16 X |
| 5,501,464 | 3/1996 | Dalbo | 473/212 |
| 5,551,086 | 9/1996 | Albanese | 70/16 X |

*Primary Examiner*—Suzanne Dino Barrett
*Attorney, Agent, or Firm*—Coats & Bennett, P.L.L.C.

[57] ABSTRACT

An anti-abduction device for preventing or discouraging the unlawful abduction of a child or person. The anti-abduction device comprises a pair of bracelets with each bracelet being adapted to fit around the arm of a person. More particularly, the bracelets include an interconnecting structure that enables the bracelets to be interconnected. In use the bracelets are disposed about the arms of a child or person. In an abduction threat the child or person places his or her arms around an object. Because the bracelets assume an interconnected mode after the arms have been extended around the object, it follows that the child or person is effectively tied to the object and this will serve to frustrate the abduction attempt.

8 Claims, 5 Drawing Sheets

ANTI-ABDUCTION DEVICE

FIELD OF THE INVENTION

The present invention relates to anti-abduction devices and more particularly to an anti-abduction device of the type that includes two interconnected bracelets that are worn by a child or other person.

BACKGROUND OF THE INVENTION

Children in this country and throughout the world are being unlawfully abducted at an increasing rate. This, of course, is a most serious problem because in the end, abducted children, if they survive, are often scarred for life. Unfortunately, the problem of protecting children from abduction has been with us a long time and is a very difficult problem to solve. There have been attempts by others to devise various devices that are aimed at preventing or inhibiting the abduction of children. One type of device is a leash mechanism that is worn by the child and which extends from the child to where it is tied to a parent or other adult. This obviously requires the child be effectively tied to the parent or adult on a continuing basis. This can be unduly restrictive for both the parent and the child. In any event and for whatever reason, these leash type devices have not met with any substantial commercial success.

Experts on child abduction tell us that the first ten seconds of an attempted child abduction is a very critical time period. That is, if some obstacle can be interposed in the abduction attempt during the first ten seconds, then in many cases the criminal attempting the abduction will be frustrated and will flee the scene so as to avoid being caught. With this in mind, the present invention addresses the child abduction problem by attempting to frustrate the abduction attempt within the first ten seconds or within the initial period of the abduction attempt.

SUMMARY OF THE INVENTION

The present invention entails an anti-abduction device that is designed to be used by children and other persons that might be the target of an abduction attempt. The device of the present invention comprises two arms bracelets, with each bracelet being adapted to fit and be worn about the arm of a child or other person. Incorporated into the structure of the bracelets is an interconnecting structure. That is the two bracelets are interconnected or can be easily and quickly interlocked. In the way of an example, the anti-abduction device of the present invention comprises two arm bracelets that are interconnected by one or more cables. The bracelets are designed to be secured together and worn on a single arm. However, in the case of an abduction attempt, one bracelet is readily separable from the other and once separated each bracelet encompasses a separate arm while the interconnecting cable effectively ties the two bracelets together.

In the embodiment disclosed herein, the two bracelets are typically worn on one arm. In the event of an abduction attempt the child or other person will look for an object such as a lamp pole, tree, etc. Once a reachable object has been identified, the child will extent his or her arms around the object and will then transfer one of the two bracelets to the other arm and because the bracelets are interconnected via cables, the child becomes effectively tied to the object. Accordingly, the abduction attempt can be frustrated, and if only momentarily, that may be sufficient to spoil the abduction attempt.

It is therefore an object of the present invention to provide an anti-abduction device for use by a child or other person that will frustrate an abduction attempt and will tend to cause the criminal attempting to perpetrate the crime to flee the scene.

Other objects and advantages of the present invention will become apparent and obvious from a study of the following description and the accompanying drawings which are merely illustrative of such invention.

DETAILED DESCRIPTION OF THE INVENTION

Figure 1:
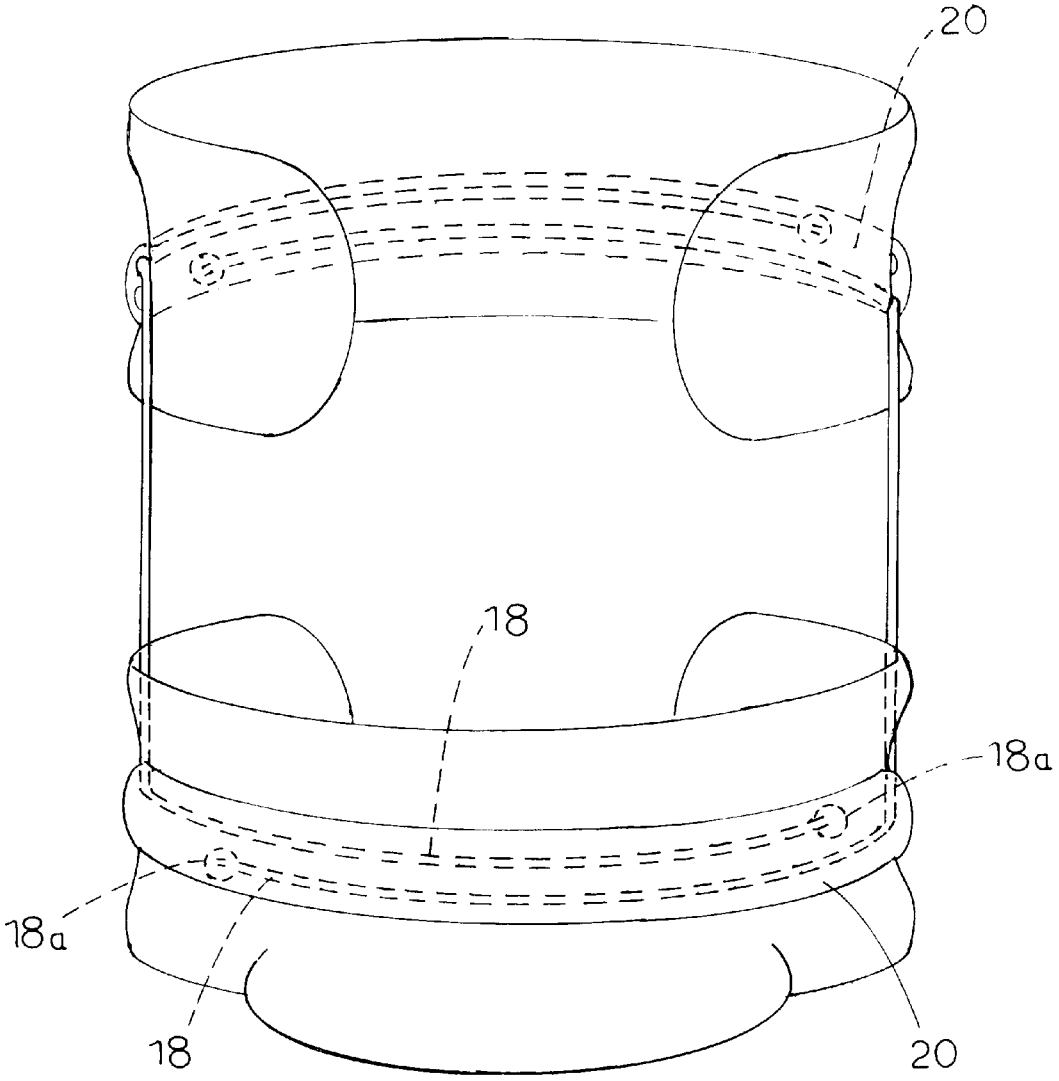
FIG. 1 is a perspective view showing the anti-abduction device of the present invention.

With further reference to the drawings, the anti-abduction device of the present invention is shown therein and indicated generally by the numeral 10. As will be appreciated from subsequent portions of this disclosure, the anti-abduction device of the present invention is designed and adapted to be worn about the arms of a child or other person. More particularly, in response to an abduction attempt, the person being accosted acts to locate an object and then extends his or her arms around the object after which the anti-abduction device 10 is interconnected between the arms so as to effectively secure the person about the object.

Viewing the anti-abduction device 10 in more detail, it is seen that the same includes a pair of bracelets indicated generally by the numerals 12 and 14. Each bracelet in the preferred embodiment is formed of a molded, generally flexible and durable plastic material and is designed to be worn about the arm of a child or other person. Each of the bracelets 12 and 14 include a band portion that extend in a generally circular fashion but wherein there is provided an opening formed within the band that enables the respective bracelets to be laterally inserted onto or removed from the arm of a person. In addition, the band portion of each bracelet includes a particular curvature. That is, as seen in the drawings, each bracelet includes an outer surrounding surface that assumes a generally concave shape. In addition, the inner portions of the bracelets 12 and 14 is configured and shaped so as to assume a generally convex shape. Thus it is appreciated that because of the general flexible nature of the bracelets 12 and 14 that these bracelets can be disposed one over the other in such a fashion that the two bracelets will be effectively connected or associated together.

One of the bracelets, bracelet 14, is provided with a lip 16. The lip 16 is formed about one edge of the bracelet 14 opposite the opening formed in the surrounding band of the bracelet. As will be appreciated from subsequent portions of this disclosure, the lip 16 assists the child or person in transferring bracelet 14 from one arm to another arm.

The two bracelets 12 and 14 are interconnected by an interconnecting structure. In the embodiment disclosed herein, there is provided a pair of flexible cables 18 that are interconnected between the bracelets 12 and 14. In the case of the present design, each of the cables 18 are designed to retract and extend with respect to at least one of the bracelets 12 and 14. To achieve this function, in a simple and effective way, the embodiment shown herein includes a pair of slip grooves 20 formed in each bracelet 12 and 14. Each slip groves 20 functions to receive and hold a portion of each cable 18 and each cable is designed to slip or move through the slip grooves. In the design shown herein, each flexible cable includes a pair of opposed stops 18*a* formed on opposite ends of the cable. Each cable, in a retracted position, extends through at least one of the slip grooves 20 formed on a respective bracelet 12 or 14. The stops 18*a* retain the respective cables 18 within the slip grooves so as to prevent the cables from becoming disconnected from the bracelets themselves. That is, where the cables exit the slip grooves 20, each cable passes through an opening or aperature that is smaller than the stop 18*a*. Thus the stop 18*a* is prevented from exiting the slip groove 20.

In a normal mode of use, the two bracelets 12 and 14 are worn about a single arm. In fact, bracelet 14 that includes the lip 16 is disposed or worn over the other bracelet 12. In this case, it is appreciated that the concave-convex shape enables the outer bracelet 14 to be effectively clipped or secured to the inner bracelet 12. In this mode, the respective cables 18 assume a generally retracted position within the bracelets. In the case of the embodiment shown in the drawings, the respective cables 18 are simply pushed or positioned within the slip grooves 20 such that a substantial portion of the cables 18 are contained within the slip grooves 20 of the respective bracelets 12 and 14. As will be appreciated from other portions of this disclosure, in this mode it is important for the lip 16 formed on the outer bracelet 14 to be positioned generally on the inner side of the arm. That is, the outer bracelet 14 is positioned such that the lip 16 faces the other arm. Therefore, it is appreciated that in a normal mode of operation, the two bracelets 12 and 14 are secured together and are worn in a concentric fashion about one arm.

The basic premise of the present invention is that abduction attempts directed at children and others can be prevented by frustrating the abduction within the very early periods of the abduction attempt. In the present case, the anti-abduction device 10 is designed to aid a child or person, that is under the threat of an abduction attempt, to tie him or herself to an object such as a lamp post, tree, or other structure. In the sequence of drawings illustrated in FIGS. 2–9, the object is illustrated as being a pole or upright structure and is indicated by the numeral 22.

Figure 2:
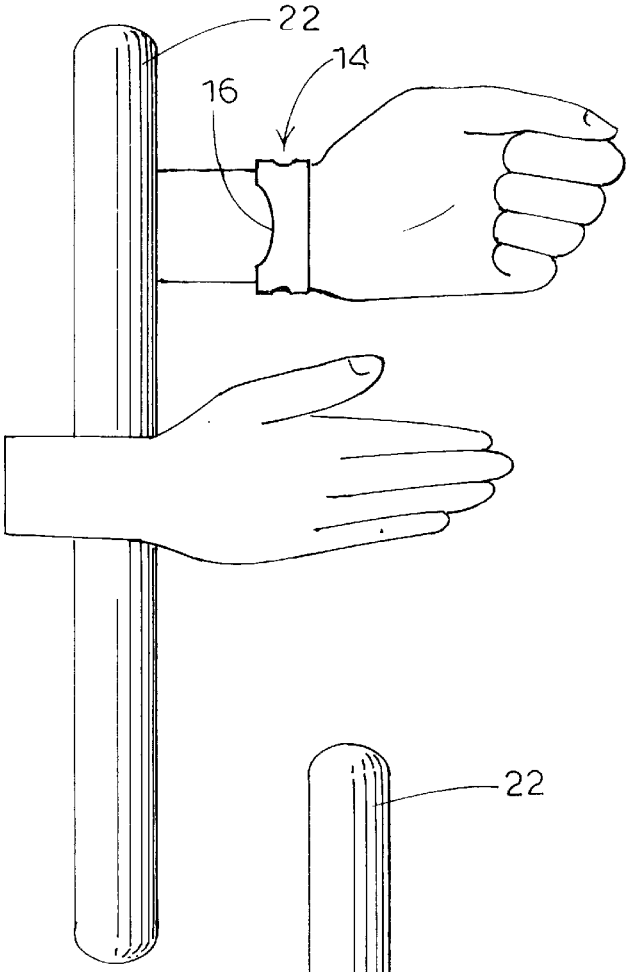
FIG. 2 illustrates a person having the anti-abduction device of the present invention worn on a single arm with the person extending his or her arms past an object.

In the case of an abduction attempt, the child or person identifies the object 22. As soon as this identification is made the child or person makes an effort to reach the object 22 and to extend both arms around the object as shown in FIG. 2. Note that the anti-abduction device 10 is being worn around the left arm about the wrist area. In particular, the bracelet 14 is snapped over and on to the inner bracelet 12 with the lip 16 of the outer bracelet 14 facing the other arm.

Figure 3:
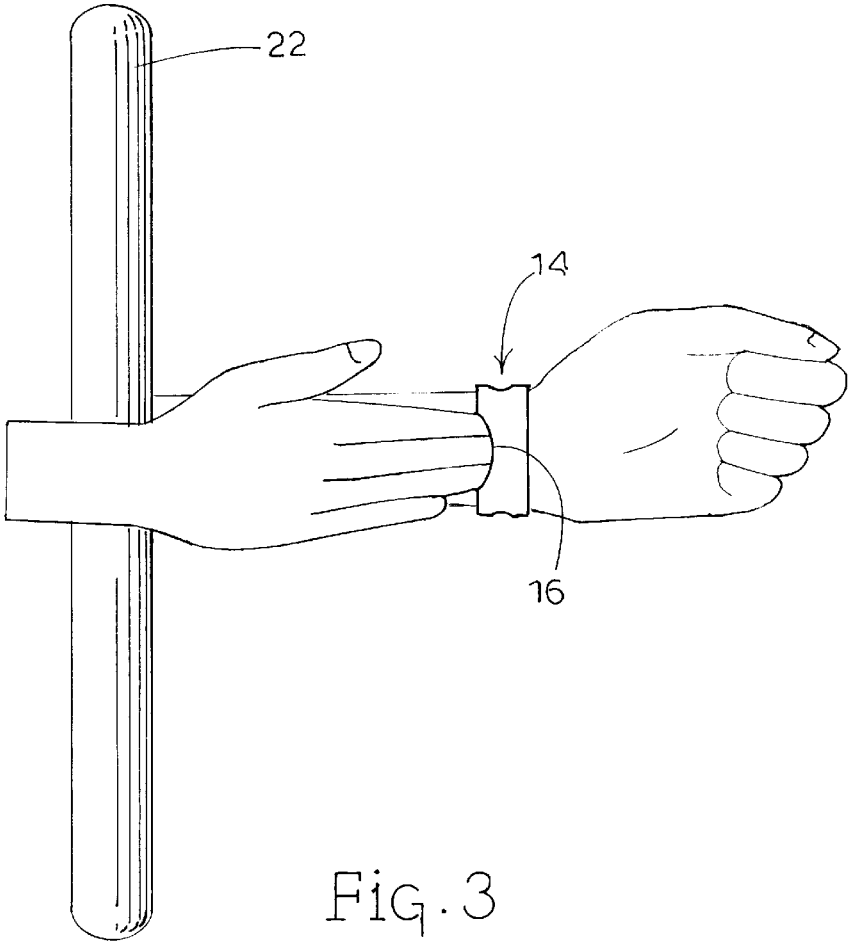
FIG. 3 illustrates the person extending one hand into the anti-abduction device.
Figure 4:
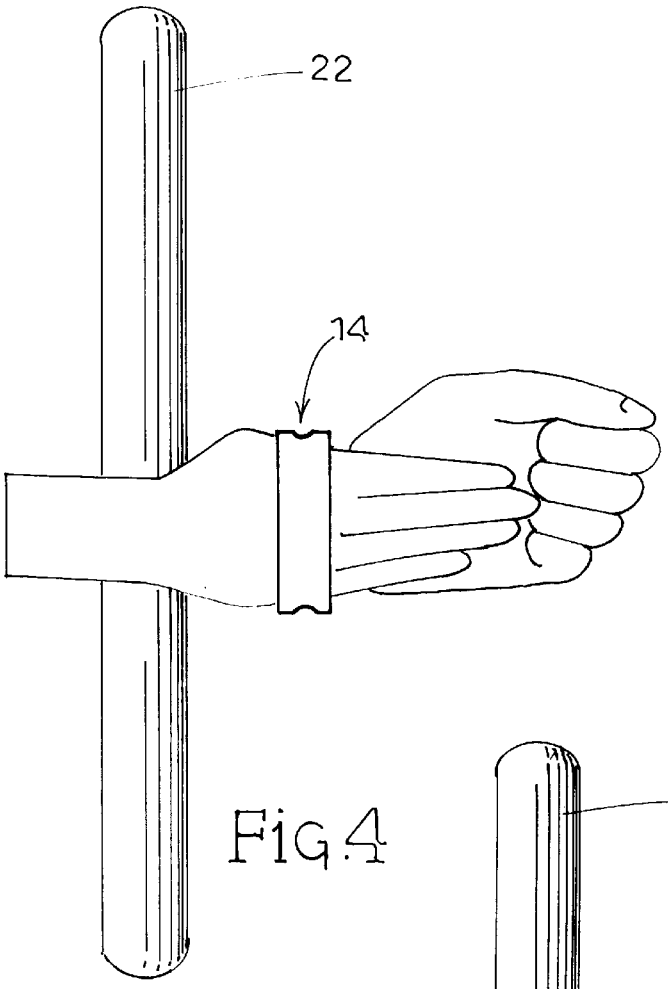
FIG. 4 illustrates the person extending that hand on through the anti-abduction device.

Once the arms have been extended around the object 22, then the right hand of the person is inserted under the lip 16 as shown in FIG. 3. The right hand is then further extended through the outer bracelet 14 and in the process the outer bracelet 14 is pulled or separated from the inner bracelet 12. See FIG. 4.

Figure 5:
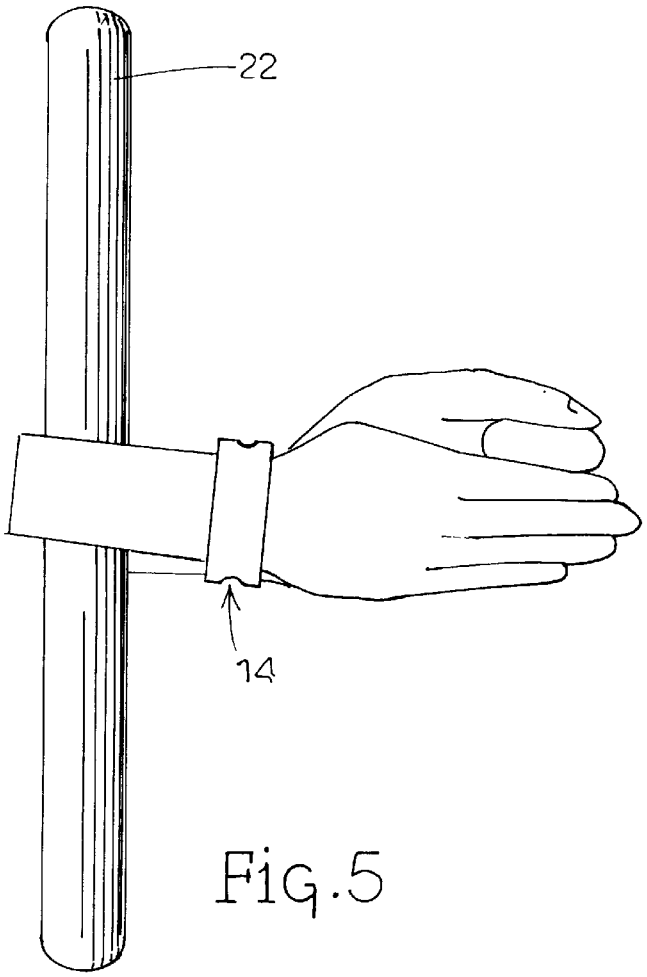
FIG. 5 illustrates the anti-abduction device extending around both arms of the person.
Figure 6:
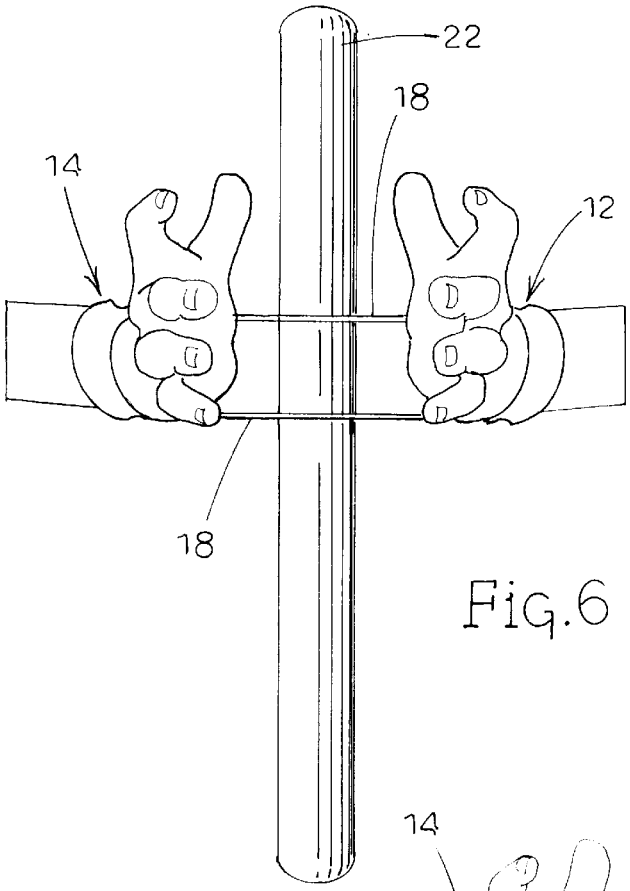
FIG. 6 is an end view showing the anti-abduction device and its interconnecting structure extending on one side of the object.
Figure 7:
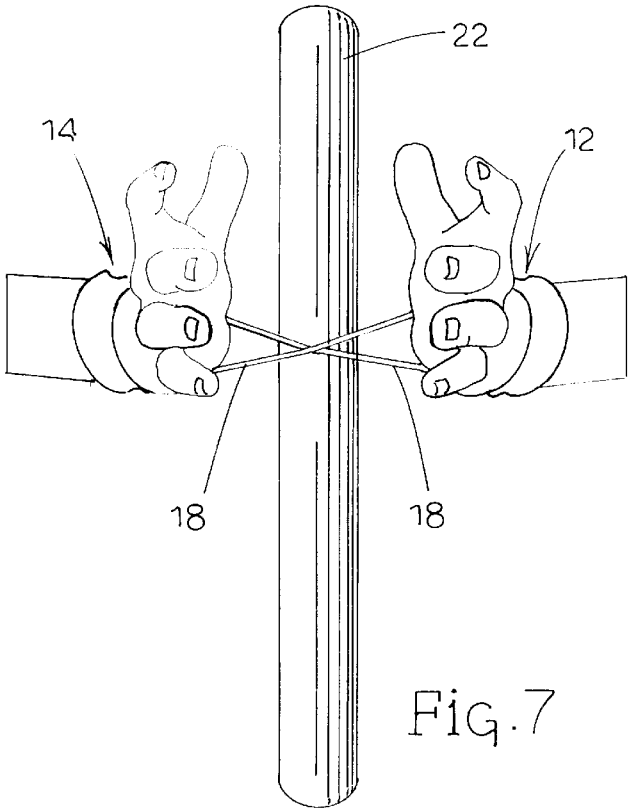
FIG. 7 is a view similar to FIG. 6, but wherein the interconnecting structure is crossed.
Figure 8:
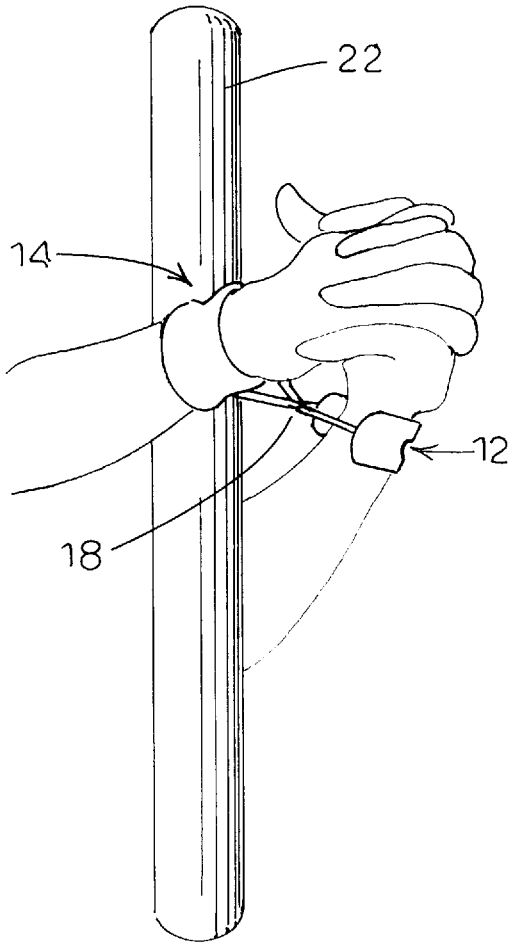
FIG. 8 is a perspective view illustrating the anti-abduction device secured to the arms of the person and effectively securing the person to the object.
Figure 9:
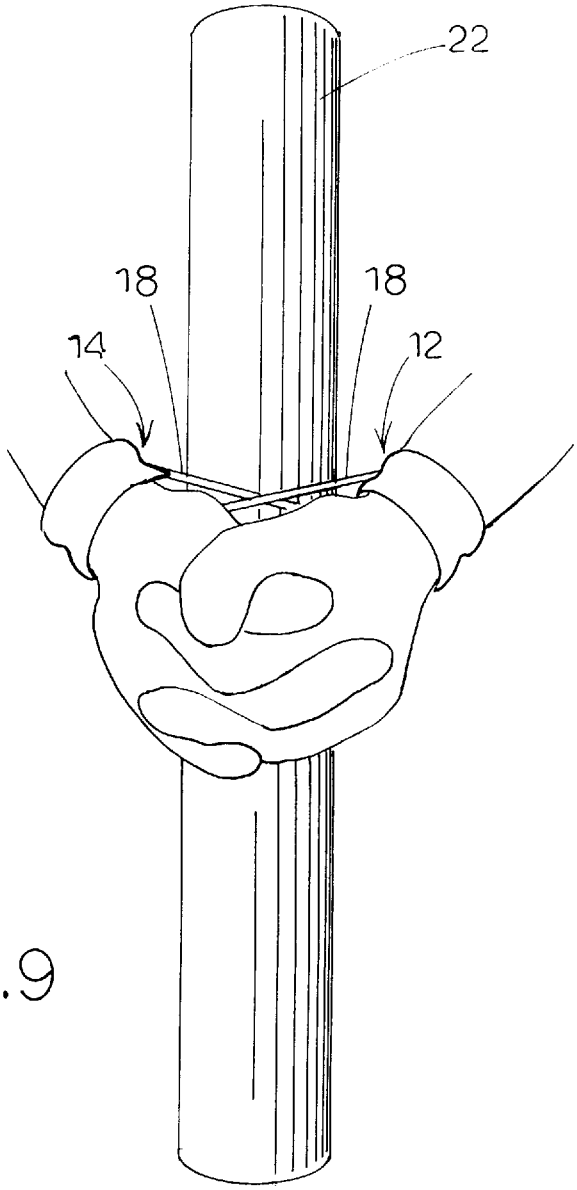
FIG. 9 is another perspective view of the anti-abduction device interconnected between the arms of a person such that the person is secured to the object.

Continuing to refer to the drawings and FIG. 5, the right hand is slipped entirely through the outer bracelet 14 such that the bracelet rests around the right arm of the person in the wrist area. In this process, the bracelets 12 and 14 are complete separated. As indicated in FIG. 6 this separation has resulted in the extension of the cables 18 that effectively interconnects bracelets 12 and 14 together. To make it more difficult to remove the bracelets 12 and 14 from the arms of the person, it is suggested that one hand be rotated through a 360 degree turn so as to create a cross configuration of the cables as shown in FIG. 5. This procedure twists and creates tension on the flexible cables 18.

Next the child or person clasps his or her hands together so as to tightly interlock the fingers and the thumbs. See FIG. 8. Immediately after clasping the hands together, the child or person pulls his or her hands towards the stationary object 22 and this has the affect of applying tension to the cables 18. Thus, the child or person is effectively tied or anchored to the object of 22 and this will have the effect of frustrating the criminal attempting to abduct the child or person.

The bracelets 12 and 14 can be formed in various sizes and because of the flexible nature of the plastic construction used in the preferred embodiment, the arm sizes of the bracelets can be adjusted by simply closing or opening the bracelets. While plastic may be a preferred or desirable material for the bracelets, other materials may be used as well. In any event, it may be appropriate to line the inner surfaces of the bracelets 12 and 14 with a relatively soft material such as foam or cloth. This will avoid scrapping, scratching or chaffing the wrist.

As discussed above, the respective bracelets 12 and 14 are interconnected by one or more cable type devices. As used herein, the term cable means any flexible or pliable connectors such as a band, string, etc. Also in the preferred embodiment it is contemplated that the cable structure would assume the form of a plastic coated steel cable.

In this disclosure, the interconnecting structure shown is a pair of cables. But it will be appreciated that other types and forms of connectors can be used to interconnect, attach or lock the bracelets before or after the arms have been extended around the object. The cables illustrated herein are one example of suitable connecting means.

Also, the bracelets can be incorporated with identification information that may assist in the future location of abducted or lost children. This can be achieved by the purchaser of the anti-abduction device completing a form identification card with certain identification information such as name and phone number as well as the serial number of the particular anti-abduction device. This information can be returned and entered into a central data base and stored. It is contemplated that the bracelets would be provided with a toll free phone number. A person finding the bracelets would call the toll free number and the parents of the lost child and/or police would be immediately contacted.

From the foregoing specification, it is appreciated that the anti-abduction device 10 of the present invention can be readily worn by a child or other person and that it does provide a practical and effective deterrent towards child abduction.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended Claims are intended to be embraced therein.

What is claimed is:

1. An anti-abduction device for effectively securing a person to an object and inhibiting the abduction of the person, comprising: a pair of bracelets with the bracelets being connectable together such that they can be worn together on one arm and wherein the bracelets are separable such that each bracelet can be worn on a separate arm of the person; at least one of the bracelets including a lip portion that enables a persons hand to be inserted inwardly of the lip so as to effectively separate the bracelet having the lip from the other bracelet; and at least one cable interconnected between the two bracelets for extending at least partially around the object while the bracelets are worn on opposite arms of the person such that the persons body and arms along with the cable at least partially surrounding the object and secure the person to the object.

2. The anti-abduction device of claim 1 wherein there is provided a pair of cables interconnected between the two bracelets.

3. The anti-abduction device of claim 2 wherein each of the cables are retractable and extendable from at least one of the bracelets.

4. The anti-abduction device of claim 3 wherein each of the bracelets includes a surrounding band portion having a concave outer surface portion and wherein when the bracelets assume a position on opposed arms of a person the respective cables lie in part on the concave surface of the respective bracelets.

5. A method of preventing and discouraging the abduction of children and other persons comprising: securing a bracelet to each arm of a person, extending the arms of the person around an object and interconnecting the bracelets so as to effectively tie that person to the object.

6. The method of claim 5 wherein the two bracelets include an interconnecting cable structure that enable the two bracelets to be separated from each other but remain interconnected.

7. The method of claim 5 wherein the bracelets are adapted to be associated with each other and worn about a single arm and in response to an abduction attempt the two bracelets may be separated such that each bracelet assumes a position on a respective arm.

8. The method of claim 5 wherein the bracelets include an interconnecting cable structure that is retractable and extendable with respect to at least one bracelet.

* * * * *

US005996380C1

(12) REEXAMINATION CERTIFICATE (4767th)

United States Patent

Harris

(10) Number: US 5,996,380 C1

(45) Certificate Issued: Apr. 15, 2003

(54) ANTI-ABDUCTION DEVICE

(75) Inventor: Christopher L. Harris, 8811 Autumn Winds Dr., #302, Raleigh, NC (US) 27615

(73) Assignee: Christopher L. Harris, Raleigh, NC (US)

Reexamination Request:
No. 90/006,204, Feb. 12, 2002

Reexamination Certificate for:

| | |
|---|---|
| Patent No.: | **5,996,380** |
| Issued: | **Dec. 7, 1999** |
| Appl. No.: | **09/185,314** |
| Filed: | **Nov. 3, 1998** |

(51) Int. Cl.[7] ..... E05B 75/00

(52) U.S. Cl. ..... 70/16; 128/878; 473/212; 119/856

(58) Field of Search ..... 70/15–17; 24/16 PB; 119/770, 792, 810, 811, 816, 817, 856, 857; 473/212, 213, 447, 448, 450; 602/16, 21, 63; 482/74, 116, 124

(56) References Cited

U.S. PATENT DOCUMENTS 3,007,331 A * 11/1961 Irwin ..... 70/16
4,162,622 A * 7/1979 Daleo ..... 70/16
5,894,748 A * 4/1999 Capperrune ..... 70/16

OTHER PUBLICATIONS

Earth First!, Backwoods Direct Action!, http://headwaters–ef.enviroweb.org/backwoods.html.*

Ehrentreu, Rachel. "Disoriented," Copyrighted Aug. 12, 1997. http://members.nbci.com/EMXC/stories/dg/DISORIO9.TXT.*

* cited by examiner

*Primary Examiner*—Lloyd A. Gall

(57) ABSTRACT

An anti-abduction device for preventing or discouraging the unlawful abduction of a child or person. The anti-abduction device comprises a pair of bracelets with each bracelet being adapted to fit around the arm of a person. More particularly, the bracelets include an interconnecting structure that enables the bracelets to be interconnected. In use the bracelets are disposed about the arms of a child or person. In an abduction threat the child or person places his or her arms around an object. Because the bracelets assume an interconnected mode after the arms have been extended around the object, it follows that the child or person is effectively tied to the object and this will serve to frustrate the abduction attempt.

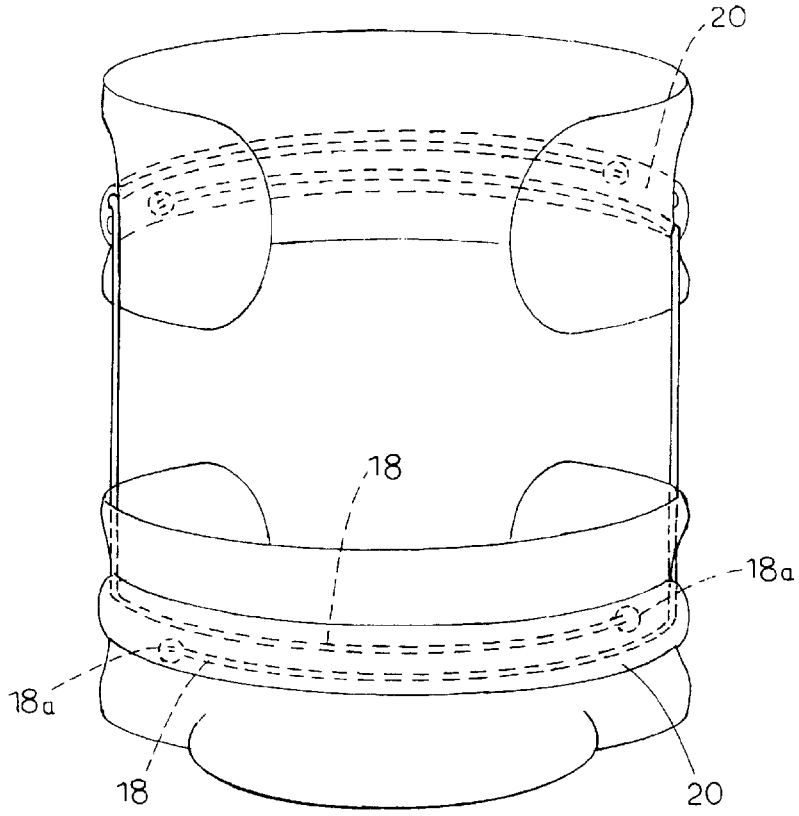

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–4 is confirmed.

Claims 5–8 are cancelled.

* * * * *